US005740608A

United States Patent [19]

Long

[11] Patent Number: 5,740,608

[45] Date of Patent: Apr. 21, 1998

[54] METHOD OF MAKING AND STACKING ELECTRICAL LEADS

[75] Inventor: Alden Owen Long, Carlisle, Pa.

[73] Assignee: The Whitaker Corporation, Wilmington, Del.

[21] Appl. No.: 609,703

[22] Filed: Mar. 1, 1996

[51] Int. Cl.[6] ..... H01R 43/052; H01R 43/28

[52] U.S. Cl. ..... 29/863; 29/33 F; 29/33 M; 29/564.8; 29/748

[58] Field of Search ..... 29/857, 861, 863, 29/564.4, 747, 748, 33 M, 33 F, 564.8, 753; 140/93 R; 242/7.06, 7.17; 198/469.1, 474.1

[56] References Cited

U.S. PATENT DOCUMENTS

| | | | |
|---|---|---|---|
| 4,077,118 | 3/1978 | McKeever | 29/748 |
| 4,145,807 | 3/1979 | Beetz et al. | 29/564.8 X |
| 4,165,768 | 8/1979 | Gudmestad | 140/140 |
| 4,175,316 | 11/1979 | Gudmestad | 29/564.4 |
| 4,464,879 | 8/1984 | Loesch | 53/428 |
| 4,502,586 | 3/1985 | Dusel et al. | 198/345 |
| 4,549,335 | 10/1985 | Gorris et al. | 29/857 X |
| 4,653,160 | 3/1987 | Thorkild | 29/33 M |
| 5,230,147 | 7/1993 | Asaoka et al. | 29/748 X |

FOREIGN PATENT DOCUMENTS

| | | | |
|---|---|---|---|
| 0 250 918 | 1/1988 | European Pat. Off. | H01R 43/00 |
| 0 359 686 | 3/1990 | European Pat. Off. | H05K 13/06 |
| 2 678 134 | 12/1992 | European Pat. Off. | H05K 13/06 |
| 41 28 599 A 1 | 3/1992 | Germany | H05K 13/06 |
| 42 21 828 C 1 | 8/1993 | Germany | H01R 43/02 |
| 2 193 124 | 2/1988 | United Kingdom | H02G 1/12 |
| 8905047 | 6/1989 | WIPO | 29/748 |

*Primary Examiner*—Peter Vo
*Attorney, Agent, or Firm*—Bradley N. Ditty

[57] ABSTRACT

An automated method of making and stacking electrical leads (66) is disclosed. The machine (50) for making the leads (66) includes a maneuvering clamp (102) that grips an end (72) of the lead and, while pivoting and moving along a defined path (104), manipulates the lead (66) to form a U-shaped portion (110) and substantially parallel side legs (112, 116). The U-shaped portion (110) is picked up by a projection (90) on a conveyor belt (88), the lead being folded over to about one half its length, and is transported to a stacking tray (100).

14 Claims, 6 Drawing Sheets

METHOD OF MAKING AND STACKING ELECTRICAL LEADS

The present invention relates to the manufacture of electrical leads and more particularly to a method for making and stacking these leads.

BACKGROUND OF THE INVENTION

Machines that produce wire leads for use in various electrical products or equipment are typically called "lead makers" in the industry. These machines feed wire from an endless source, measuring its length precisely, then cutting it to a desired length. The ends may or may not be terminated to electrical terminals, or the ends may simply be prepared for termination. Wire supplied in the form of a so called endless source is usually contained on a reel or in a barrel and is typically over 1000 feet long, and may be up to several miles long. Such a prior art lead making machine 10 is schematically depicted in FIG. 1. The machine 10 includes a frame 12, a wire feed unit 14, two terminating units 16 and 18, a wire cutting and stripping unit 20, a lead stacking tray 22, and various transfer clamps 24 and 26 that manipulate and control movement of the wire. A horizontally disposed conveyer belt 28 is arranged vertically above the tray 22 and is used to direct the finished lead lengthwise into the tray. Wire 30 is drawn from a reel 32 by the wire feed unit 14, in the usual manner, and moved along a wire path, to the wire cutting and stripping unit 20 where the end of the wire is prepared for termination. The gripper 24 then moves the cut end of the wire to the terminator 16 for attachment of a terminal 34 thereto and then returns the terminated end to the wire path and begins feeding the wire 30 through the cutting and stripping unit 20 until a desired length is reached. The wire is again cut thereby forming a lead 36 having a terminal 34 attached to the leading end, and a freshly cut trailing end. The gripper 26 engages the trailing end and presents it to the terminator 18 for attachment of a terminal 38 while a portion of the lead 36 is resting upon the moving conveyer belt 28 which moves the leading end toward the far right end of the tray 22, as viewed in FIG. 1. When the gripper 26 releases the trailing end of the lead 36 it falls by gravity off of the belt 28 and into the stacking tray 22. The completed lead 36 is shown in FIG. 2. By way of example, a machine similar to the machine 10, as described above, is manufactured and distributed by AMP Incorporated under the trademark "AMPOMATOR CLS 111" and is well known in the industry.

The main portion of the machine 10 has a length indicated by L1, in FIG. 1. The lead stacking tray 22 forms an extension of the machine 10 having a length indicated by L2 for a total machine length of L1 plus L2. The actual length of L2 is usually at least as long as the length of the leads 36 that are being manufactured. Such lead lengths typically range from a few inches to several feet, and occasionally can reach a length of over two hundred and fifty inches. Such lengths result in an overall machine length that is difficult to accommodate in some manufacturing facilities. In some cases the tray 22 is open ended or simply not present and the leads are allowed to fall to the floor causing unorganized and tangled masses of leads that must later be sorted out manually.

What is needed is a method of orderly stacking these leads in a tray that is about one half the length of the lead being produced so that the overall length of the machine 10 is within acceptable limits.

SUMMARY OF THE INVENTION

An automated machine is provided having a wire feed unit, a wire cutting unit, and a wire lead stacking tray. The invention is an automated method of making and stacking a plurality of electrical leads by means of this machine. The machine draws from a continuous supply of wire, making leads, each of which has a first end, a second end, and a predetermined length. The method includes the steps: feeding the wire along a wire path to the wire cutting unit; cutting the wire thereby forming the first end of a lead; grasping the first end and pivoting it out of alignment with the wire path; while the first end is out of alignment with the wire path, feeding the wire through the wire cutting unit along the wire path so that the wire forms a U-shaped portion; cutting the wire thereby forming the second end of the lead and forming a first end of another lead; then moving the lead in a first direction to the stacking tray by engaging and moving the U-shaped portion while both the first and second ends of the lead are released and trail behind the U-shaped portion.

DESCRIPTION OF THE PREFERRED EMBODIMENT

Figure 1:
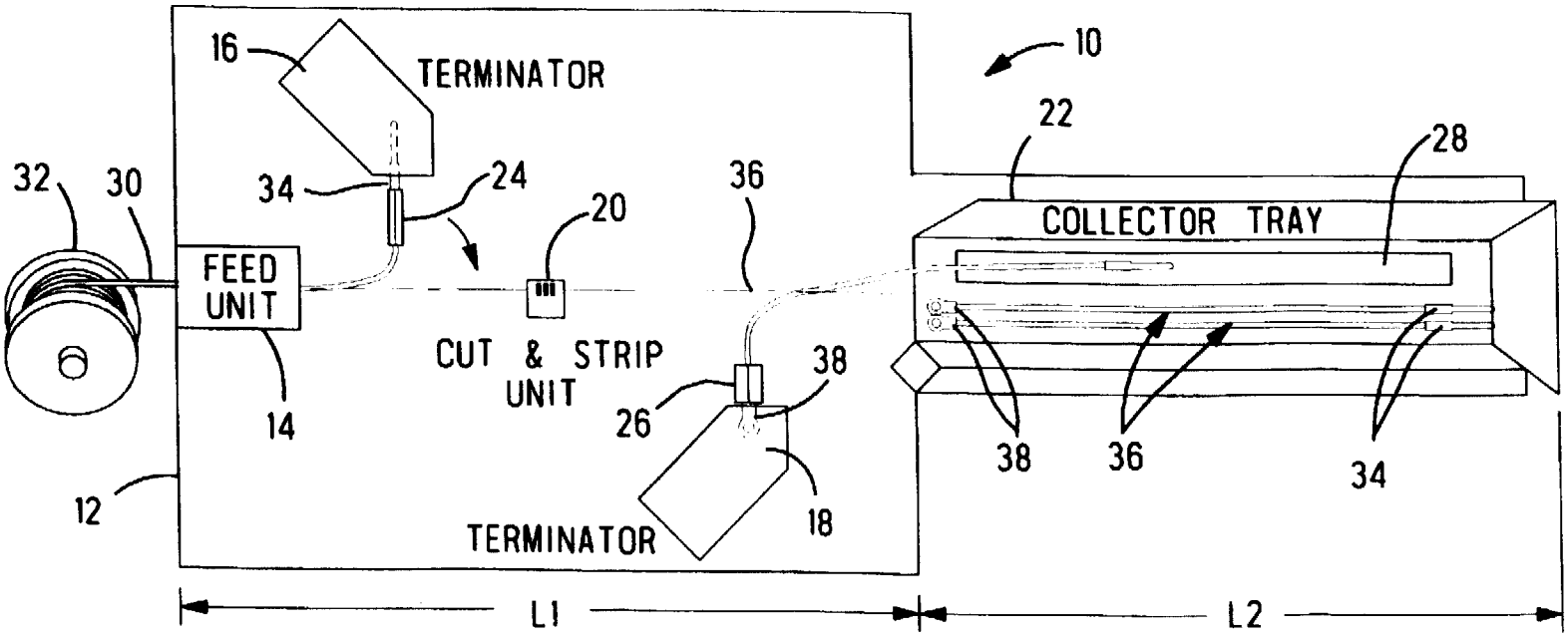
PRIOR ART FIG. 1
FIG. 1 is a schematic representation of a prior art machine for making electrical leads.
Figure 2:
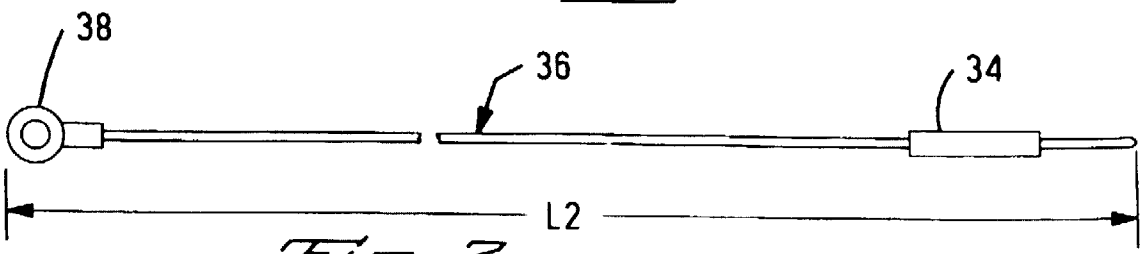
FIG. 2 is a plan view of a typical electrical lead.
Figure 3:
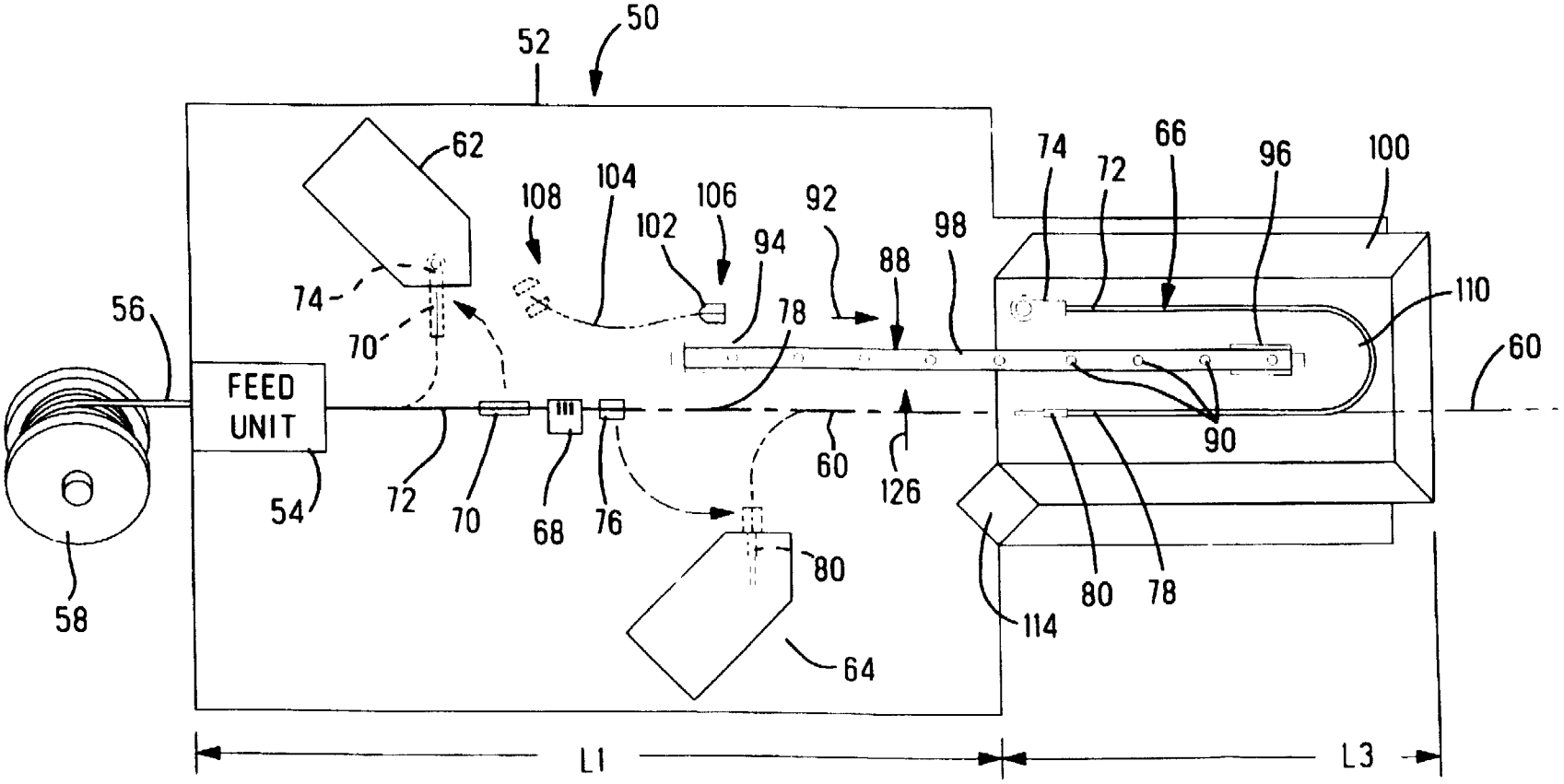
FIG. 3 is a schematic representation of a machine for making electrical leads incorporating the teachings of the present invention.

The major functional elements of a machine 50 needed in making electrical leads, in accordance with the teachings of the present invention, are schematically represented in FIG. 3. The machine 50 includes a frame 52 and a wire feed unit 54 attached to the frame arranged to draw wire 56 from a supply reel 58 and feed the wire along a wire path 60. A feed side terminator 62 and an eject side terminator 64 are attached to the frame 52, as shown in FIG. 3, and are arranged for attaching terminals to the two ends of a lead 66 that is similar to the lead 36, shown in FIG. 2. A wire cutting and stripping unit 68 is attached to the frame 52 along the wire path 60 between the two terminators 62 and 64, as shown in FIG. 3. A feed side transfer clamp 70 is coupled to the frame 52 and arranged to grip a first end 72 of the wire 56, after the cutting and stripping unit 68 has cut and stripped the wire, and transfer the first end to the feed side terminator 62 for attachment of a terminal 74 in the usual manner. Similarly, an eject side transfer clamp 76 is coupled to the frame 52 and arranged to grip a second end 78 of the wire 56, opposite the first end 72, after the cutting and stripping unit 68 has cut and stripped it, and transfer the second end to the eject side terminator 64 for attachment of a terminal 80 in the usual manner.

Figure 4:
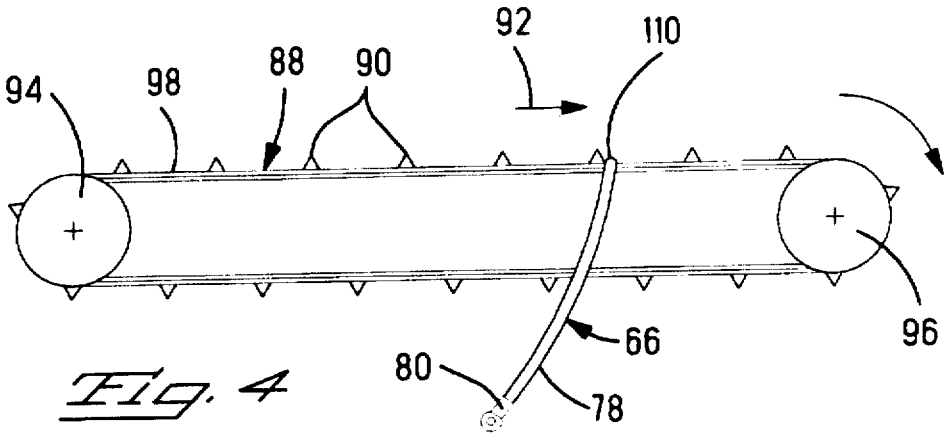
FIG. 4 is a schematic view of the conveyor belt taken in the direction of the arrow 126 in FIG. 3.

A conveyor belt 88 is disposed parallel to the feed path 60, as shown in FIGS. 3 and 4, and includes several projections 90 extending outwardly from its surface and are equally spaced along its length. The belt is continuous, and extends around a drive pulley 94 and an idler pulley 96, both of which are rotationally coupled to the frame 52 in the usual manner. The upper facing portion 98 of the conveyor belt, as viewed in FIGS. 3 and 4, moves in the direction of the arrow 92. The projections 90 are arranged to engage and transport the finished lead 66 to a stacking tray 100 that is disposed vertically under the right most end of the conveyor belt 88 for collecting the leads, as will be explained. A maneuvering clamp 102 is coupled to the frame 52 and includes a drive mechanism, not shown, that causes the clamp to move along a defined path 104 between a first position shown in solid lines and a second position shown in phantom lines in FIG. 3. The defined path 104 may be any suitable shape, however, it is arcuate in the present example. This movement of the maneuvering clamp 102 includes a pivoting of the clamp through an angle of about 150 degrees. The purpose of the maneuvering clamp 102 is to grip the first end 72 of the wire 56 and rotate it counterclockwise, while moving it from left to right as viewed in FIG. 3, so that a U-shaped portion 110, or bend, is formed in the wire. This bend can then be picked up by one of the projections 90 and the finished lead 66 transported to the stacking tray 100.

Figure 7:
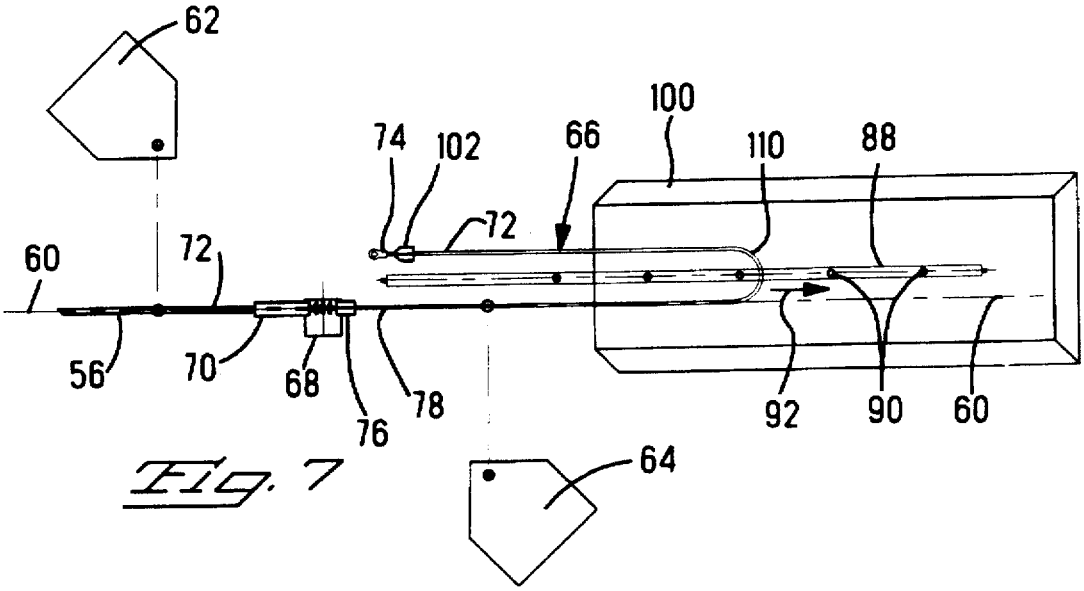
FIGS. 7 through 13 are schematic representations of a typical operating sequence of the machine shown in FIG. 3.
Figure 8:
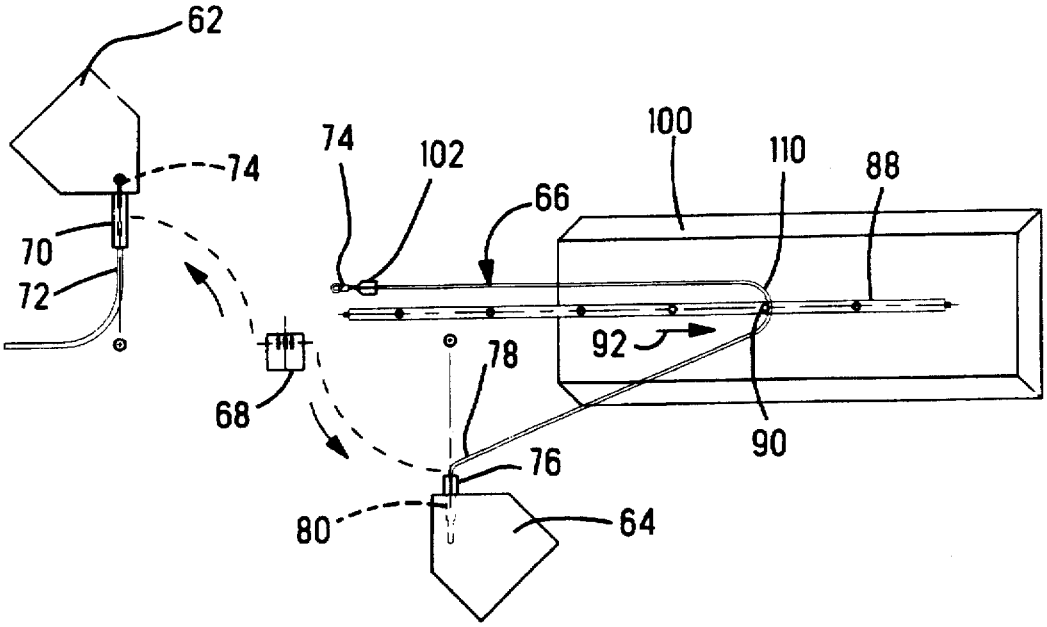
Figure 9:
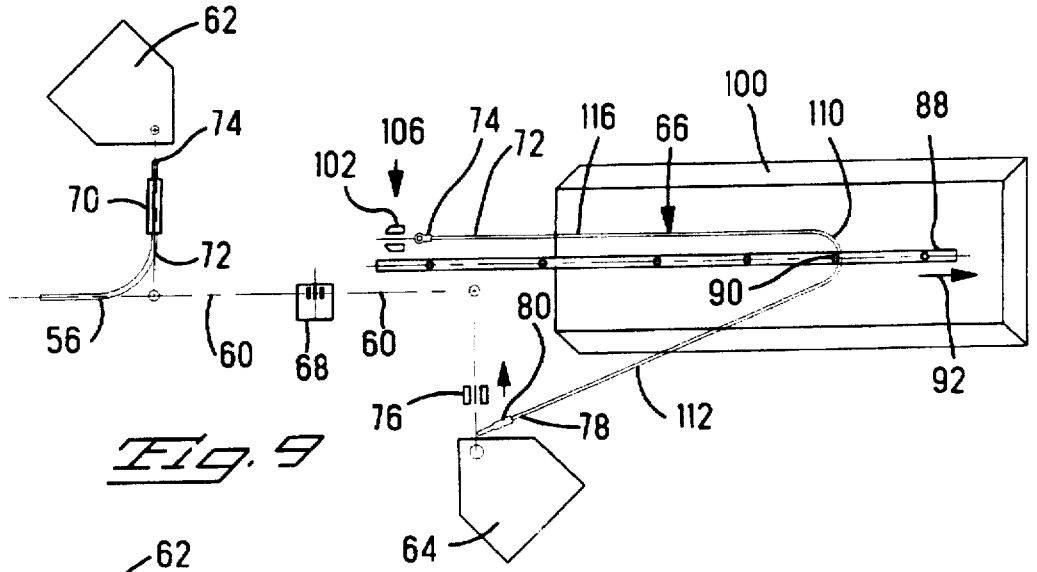
Figure 10:
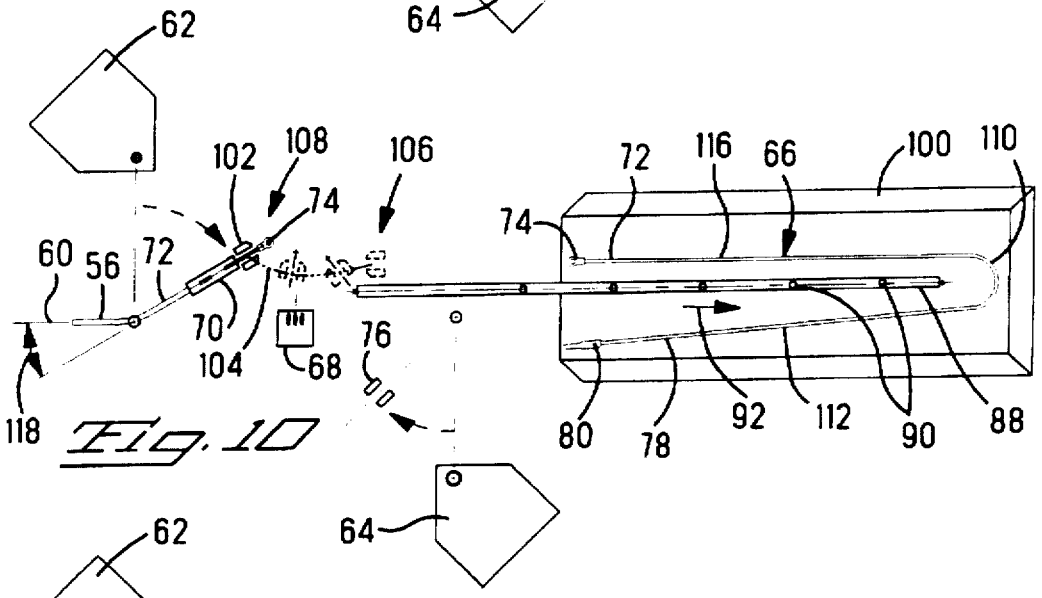
Figure 11:
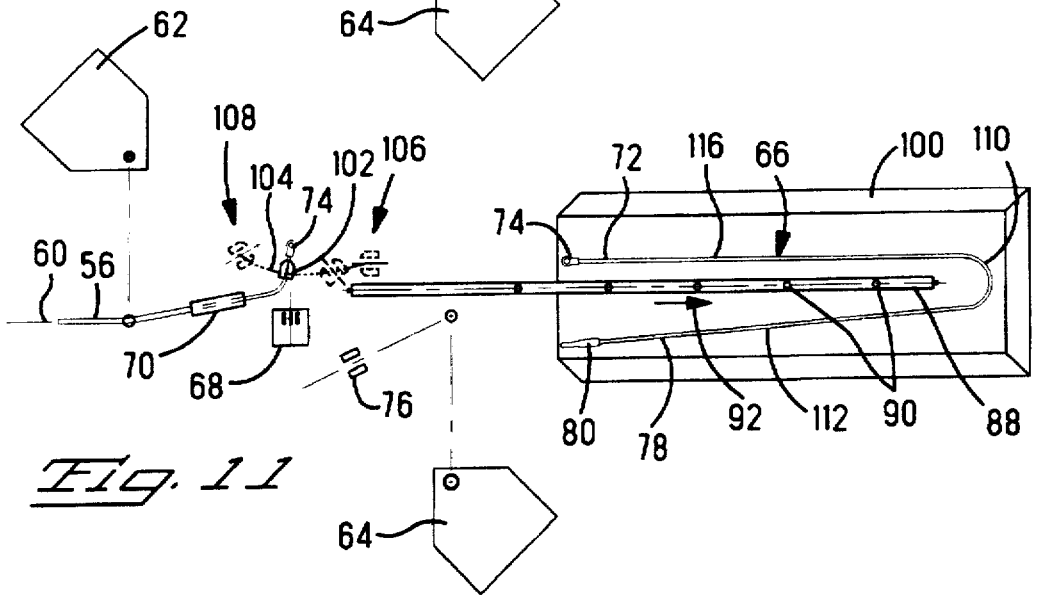
Figure 12:
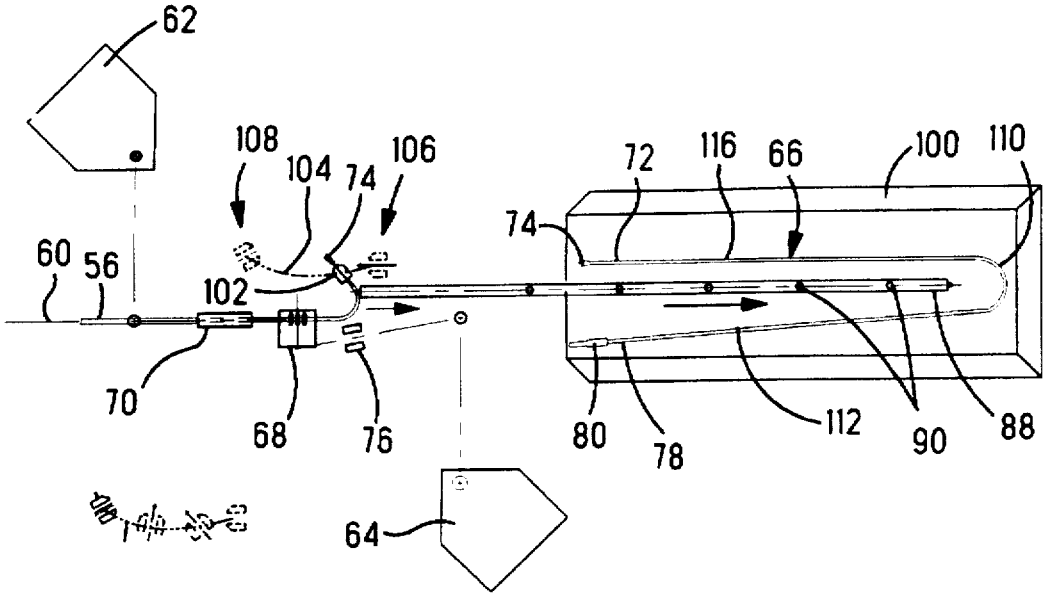
Figure 13:
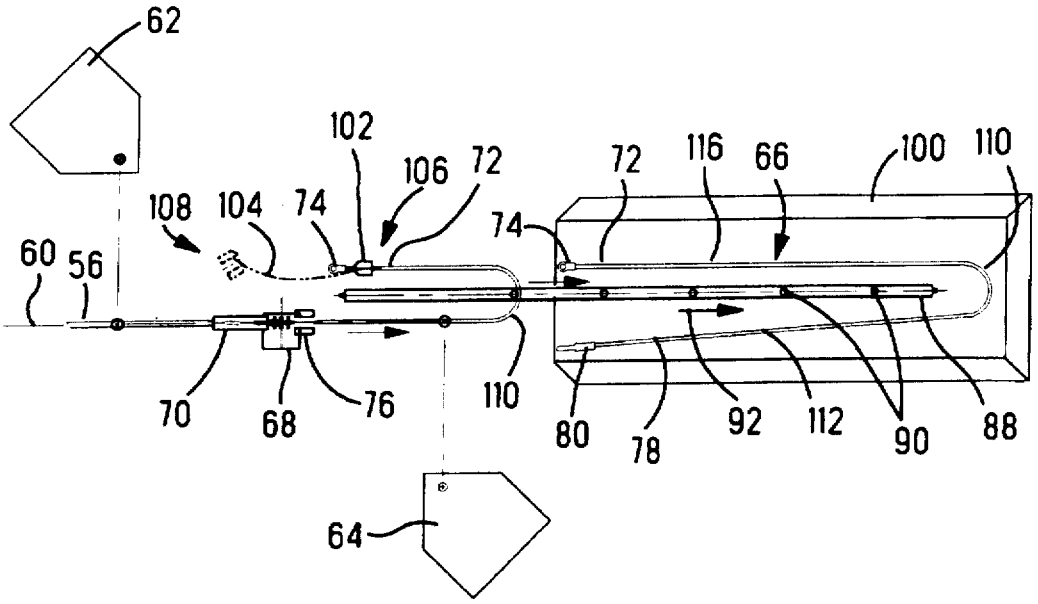

The sequence of operation of the machine 10 will now be described with reference to FIGS. 7 through 13. Each of these figures schematically depicts the wire 56 being fed along a feed path 60, the two terminators 62 and 64, the cutting and stripping unit 68, the conveyor belt 88, and the clamps 70, 76, and 102. As shown in FIG. 7, the wire 56 extends along the feed path 60 through the clamp 70, the cutting and stripping unit 68, the clamp 76, around a bend 110, and back through the maneuvering clamp 102. A terminal 74 has already been attached to the first end 72. The protrusions 90 on the running conveyor belt 88 slip under the U-shaped portion 110 while the lead 66 remains in place. At this point the cutting and stripping unit 68 is operated to cut the wire 56 thereby forming a new first end 72 and a lead 66. The unit 68 also strips the new first end 72 and the second end 78 of the lead 66. The feed side clamp 70 then is pivoted counterclockwise through an angle of about 90 degrees, in the present example as shown in FIG. 8, to move the new first end 72 to the terminator 62 where a terminal 74 is attached thereto. Concurrently, the eject side clamp 76 is pivoted counterclockwise to move the second end 78 of the lead 66 to the terminator 64 where a terminal 80 is attached thereto. The eject side clamp 76 and the maneuvering clamp open thereby releasing the lead as one of the projections 90 of the conveyor belt 88 engages the U-shaped portion 110. As the conveyor belt 88 moves in the direction of the arrow the projection 90 begins to move the lead 66 toward the right, as shown in FIGS. 4 and 9. As movement of the lead 66 continues toward the right, a lower leg 112 of the lead cams against a beveled surface 114, shown in FIG. 3, bringing the lower leg into substantially parallel alignment with an upper leg 116 of the lead. The lead 66 then falls by gravity off the right most end of the conveyor belt 88 into the stacking tray 100, as shown in FIGS. 3 and 10. Concurrently, the eject side clamp 76 begins to pivot clockwise and the feed side clamp 70 is pivoted clockwise away from the terminator 62 toward the feed path 60 to an angular position having an angle 118 that is about 30 degrees, in the present example as shown in FIG. 10. The maneuvering clamp 102 is caused to move along the defined path 104 from the first position 106 to the second position 108 where the terminated first end 72 is in alignment with the clamp, as shown in FIG. 10. As the maneuvering clamp 102 moves along the defined path 104, it pivots clockwise approximately 150 degrees so that it can receive the first end 72 of the wire 56. At this point the feed side clamp 70 is opened and the wire 56 advanced so that the end 72 is inserted into the open maneuvering clamp 102. The maneuvering clamp 102 is then closed to grip the end 72 while the feed side clamp 70 is opened to release the wire. The feed unit 54 then feeds the wire 56 while the maneuvering clamp 102 is pivoted counterclockwise, as shown in FIG. 11, and simultaneously moved back along the path 104, and the feed side clamp 70 pivots clockwise to bring the wire 56 into alignment with the wire path 60 and the cutting and stripping unit 68, as shown in FIG. 12. As the maneuvering clamp 102 continues to pivot and move toward the first position 106, the wire 56 is caused to begin forming a U-shaped portion 110, or bend, which is fully formed when the maneuvering clamp 102 has reached its first position 106, as shown in FIG. 13. Additionally, the eject side clamp 76 continues to pivot clockwise until it is again in alignment with the feed path 60, as shown in FIG. 13. At this point the U-shaped portion 110 is vertically above the conveyor belt 88, however, as feeding of the wire 56 continues, the U-shaped portion 110 moves toward the right slightly faster than do the projections 90 of the conveyor belt 88. When the correct amount of wire 56 is fed, the feed unit stops feeding, the feed side clamp 70 and the eject side clamp 76 are closed, and the cutting and stripping unit 68 is actuated to cut the wire thereby forming a new lead 66 and a new first end 72 on the wire 56, as shown in FIG. 7. This process continues until the desired number of leads 66 are manufactured.

Figure 5:
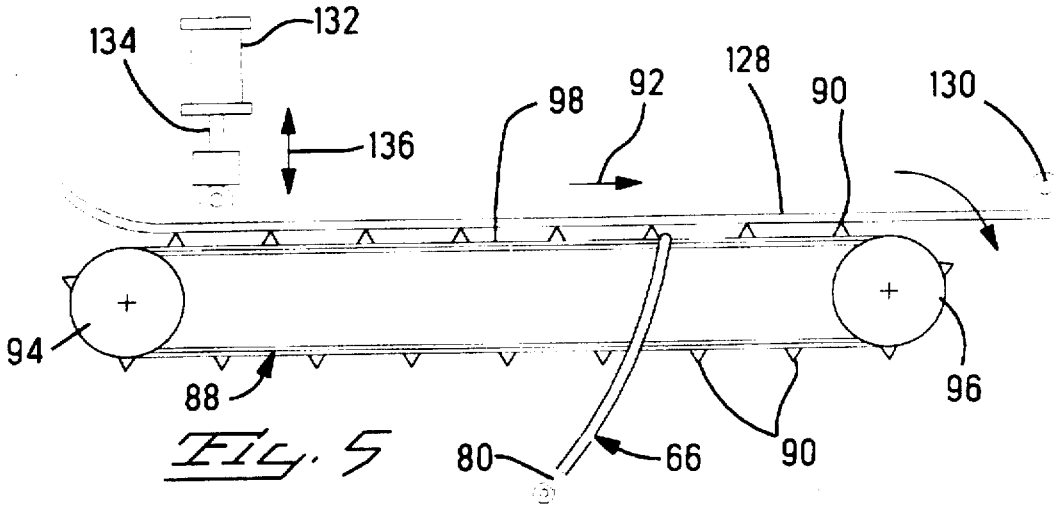
FIGS. 5 and 6 are views similar to that of FIG. 4 showing different embodiments of the present invention.

In an alternative embodiment of the machine 50, the conveyor belt 88 includes a pressor plate 128 that is pivotally attached to the frame 52 at the point 130, as shown in FIG. 5. The pressor plate 128 is disposed vertically above the upper surface 98 of the belt 88 to urge the U-shaped portion 110 of the lead 66 into engagement with the belt to assure that a projection 90 will carry the lead in the direction of the arrow 92. An air cylinder 132 is attached to the frame 52 and has its piston rod 134 coupled to the pressor plate 128 so that the end of the pressor plate opposite the pivot point 130 can be raised and lowered slightly, in the direction indicated by the arrow 136, to assure smooth entry of the lead between the pressor plate and the conveyor belt. Additionally, the pressor plate can be raised when the maneuvering clamp 102 and the eject side clamp 76 are closed so that the protrusions 90 on the running conveyor belt 88 slip under the U-shaped portion 110 while the lead 66 remains in place.

Figure 6:
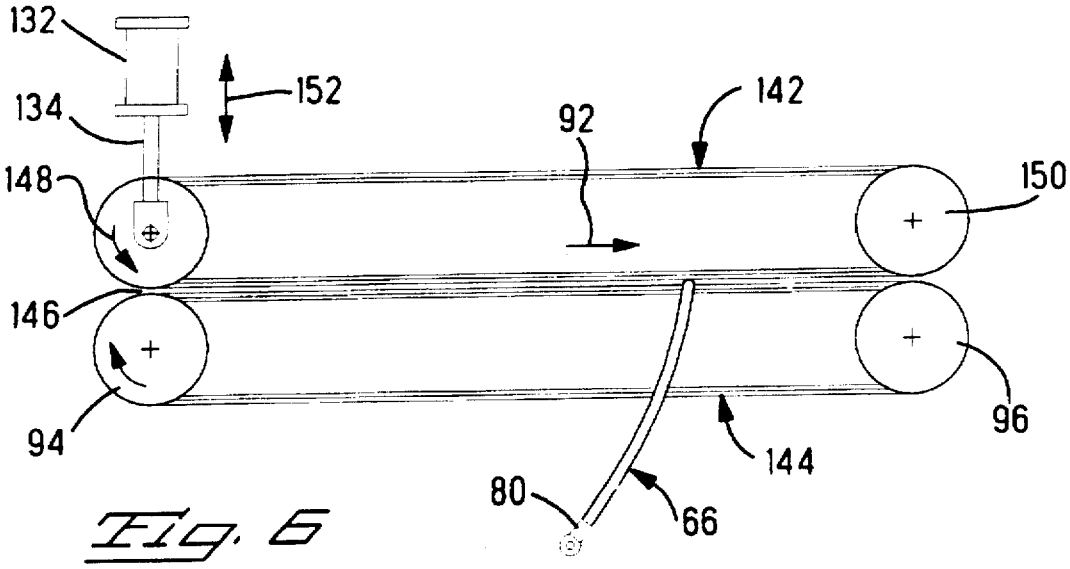

In another alternative embodiment of the machine 50, as shown in FIG. 6, a pair of opposed conveyor belts 142 and 144 are vertically arranged with a space 146 therebetween for receiving the lead 66. The conveyor belt 144 extends around a drive pulley 94 and an idler pulley 96 in a manner similar to that of the conveyor belt 88, while the conveyor belt 142 extend around a drive pulley 148 and an idler pulley 150. An air cylinder 132 is attached to the frame 52 and has its piston rod 134 coupled to the drive pulley 148 so that the drive pulley and the conveyor belt 142 can be pivoted a small amount about the axis of the idler pulley 150 so that the space 146 can be increased and decreased slightly, in the direction indicated by the arrow 152, to assure smooth entry of the lead between the two conveyor belts alternatively, the entire conveyor belt 142 may be moved away from or toward the conveyor belt 144 to increase or decrease the space 146. Note that either one or both of the conveyor belts 142 and 144 may or may not have the projections 90 extending from the outer surface in a manner similar to that of the conveyor belt 88. Additionally, the conveyor belt 142 can be raised when the maneuvering clamp 102 and the eject side clamp 76 are closed so that the running conveyor belts 142 and 144 slip with respect to the U-shaped portion 110 while the lead 66 remains in place.

In the present example, the length L1 of the machine 50 is substantially the same as the length L1 of the prior art machine 10 and the leads 36 and 66 made by the two machines are of the same length. However, since the leads 66 are arranged in a U-shape, the length 53 of the stacking tray 100 need only be about one half the length L2 of the stacking tray 22. Therefore, the total length of the machine 50 is substantially less than the total length of the prior art machine 10. Additionally, the length of the conveyor belt 88 need be only one half the length of the prior art conveyor belt 28. Further, the lead 66 is doubled over into a U-shape about one half its normal length and must be moved a distance of L3 into the stacking tray 100 in the same time that the machine 10 must move the lead 36 the distance L2. Therefore, the required speed of movement of the lead 66 to move the lead fully into its stacking tray 100 in the allotted time period is about one half the required speed of movement of the lead 36. This permits the conveyer belt 88 to move at one half the speed of the prior art belt 28. While, in the present example, the angle of pivotal movement of the feed side clamp 70 is 90 degrees from the feed path 60 to the terminator 62, as shown in FIG. 9, and the angle 118 is 30 degrees, as shown in FIG. 10, these angles are by way of example only and may be any convenient angular amount. Similarly, the angle of pivotal movement of the maneuvering clamp 102 of 150 degrees is by way of example only. The important requirement is that the maneuvering clamp 102 be able to pick up the first end 72 from the feed side transfer clamp 70. Alternatively, the maneuvering clamp 102 may move from its first position 106 to a position adjacent the terminator 62 to pick up the first end 72 without pivoting the feed side clamp 70 to the angular position indicated by the angle 118 in FIG. 10.

An important advantage of the present invention is that the overall length of the machine 50 is substantially reduced thereby permitting more efficient use of shop floor space. Another important advantage is that the conveyor belt that transports the finished leads into the stacking tray can run at one half the speed of the prior art conveyor belt thereby reducing wear and tear on the conveyor mechanism. Additionally, the folded U-shaped leads are easier to handle when unloading the stacking tray, especially when the leads are long. Further, the folded leads lend themselves to automated bundling, such as wrapping a tie around a bundle of leads at the U-shaped portion.

I claim:

1. In an automated machine having a wire feed unit, a wire cutting unit, a wire lead stacking tray, and a substantially linear wire path extending from said wire feed unit through said wire cutting unit, an automated method of making and stacking a plurality of electrical leads from a continuous supply of wire, each said lead having a first end, a second end, and a predetermined length comprising the steps:

(a) feeding said wire along said wire path to said wire cutting unit;

(b) cutting said wire thereby forming said first end of a said lead;

(c) grasping said first end and moving it out of alignment with said wire path;

(d) while said first end is out of said alignment with said wire path feeding said wire through said wire cutting unit along said wire path while pivoting said first end so that said wire forms a U-shaped portion;

(e) cutting said wire thereby forming said second end of said lead and forming a first end of another lead; then (f) moving said lead in a first direction to said stacking tray by engaging and moving said U-shaped portion while both said first and second ends of said lead trail behind said U-shaped portion.

2. The method according to claim 1 including after step (f):

(g) repeating steps (c) through (f) a desired number of times.

3. The method according to claim 1 wherein said stacking tray has a length that is about one half said predetermined length.

4. The method according to claim 1 wherein said machine includes an elongated conveyor belt having a projection adjacent said wire path and arranged to move in said first direction parallel to said wire path, and wherein said engaging and moving of step (f) is effected by said projection engaging and moving said U-shaped portion of said lead.

5. The method according to claim 4 wherein said machine includes a pressor plate adjacent said elongated conveyor belt and arranged to cooperate with said projections to aid in effecting said moving of step (f).

6. The method according to claim 5 wherein said moving of step (f) includes pivoting said pressor plate to effect smooth entry of said lead between said pressor plate and said conveyor belt.

7. The method according to claim 4 wherein step (c) includes moving said first end to a terminating unit and attaching a terminal thereto.

8. The method according to claim 7 wherein said moving in step (c) includes the steps:

(c1) pivoting said first end in one direction to a first predetermined angle to said wire path; then (c2) effecting said moving to said terminating unit; and wherein said pivoting said first end in step (d) includes: further pivoting said first end in said one direction to an angle greater than said first predetermined angle.

9. The method according to claim 8 including between steps (c2) and (d3) the step of moving said first end in a direction opposite said one direction to a second predetermined angle to said wire path, said second predetermined angle being greater than zero.

10. The method according to claim 8 wherein said machine includes a maneuvering clamp for gripping said first end and for effecting said further pivoting of step (c3).

11. The method according to claim 1 wherein said machine includes a pair of opposed conveyor belts vertically arranged and having a space therebetween for receiving said lead, and means for moving one of said conveyor belts to selectively increase and decrease said space, each said conveyor belt arranged to cooperate with the other of said conveyor belt to aid in effecting said moving of step (f).

12. The method according to claim 11 wherein said moving of step (f) includes said moving of one of said conveyor belts to effect smooth entry of said lead into said space between said pair of opposed conveyor belts.

13. The method according to claim 1, after step (e) including the step:

(e1) grasping said second end and pivoting it out of alignment with said wire path, moving said second end to another terminating unit, and attaching a terminal thereto.

14. The method according to claim 13 wherein a portion of said moving of step (f) occurs concurrently with said attaching a terminal of step (e1).

* * * * *